US011278137B2

(12) United States Patent
McDaniel et al.

(10) Patent No.: US 11,278,137 B2
(45) Date of Patent: Mar. 22, 2022

(54) GLASS DECANTER AND PROTECTIVE SHELL

(71) Applicants: Kegan McDaniel, Milwaukee, WI (US); Roberto Meza, Niles, IL (US)

(72) Inventors: Kegan McDaniel, Milwaukee, WI (US); Roberto Meza, Niles, IL (US)

( * ) Notice: Subject to any disclaimer, the term of this patent is extended or adjusted under 35 U.S.C. 154(b) by 0 days.

(21) Appl. No.: 15/931,945

(22) Filed: May 14, 2020

(65) Prior Publication Data

US 2020/0359815 A1 Nov. 19, 2020

Related U.S. Application Data

(60) Provisional application No. 62/848,241, filed on May 15, 2019.

(51) Int. Cl.

| | |
|---|---|
| ***F25D 3/08*** | (2006.01) |
| ***A47G 23/02*** | (2006.01) |
| ***B65D 81/36*** | (2006.01) |
| ***A47J 41/02*** | (2006.01) |
| ***A47G 19/12*** | (2006.01) |
| ***B65D 23/08*** | (2006.01) |
| ***B65D 23/00*** | (2006.01) |
| *B65D 81/02* | (2006.01) |

(52) U.S. Cl.

CPC ..... *A47G 19/12* (2013.01); *A47G 23/0241* (2013.01); *B65D 23/001* (2013.01); *B65D 23/0885* (2013.01); *B65D 81/02* (2013.01)

(58) Field of Classification Search

CPC ... A47G 19/12; A47G 23/0241; A47J 41/024; A47J 41/026; B65D 81/3879; B65D 23/001; B65D 23/0885; B65D 81/3881; B65D 81/3886; B65D 81/022; B65D 25/2858; A61J 1/16; A61J 1/165; F25D 2331/803; F25D 2331/809; F25D 2331/08

USPC ..... 215/355; 62/457.3, 457.8, 465, 466, 62/457.1, 457.4, 438, 400; 72/427, 426; 220/903

See application file for complete search history.

(56) References Cited

U.S. PATENT DOCUMENTS

| | | | | | |
|---|---|---|---|---|---|
| 107,189 | A * | 9/1870 | Mathieu | A47J 41/02 | 215/12.1 |
| 770,528 | A * | 9/1904 | Kestner | A47J 41/02 | 215/12.1 |
| 924,969 | A * | 6/1909 | Howard | G01F 19/002 | 73/426 |
| 1,121,349 | A * | 12/1914 | Charles | A61J 9/08 | 215/11.6 |
| 1,267,292 | A * | 5/1918 | Vanstrom | B65D 23/001 | 215/12.1 |
| 1,419,580 | A * | 6/1922 | Molinari | G01F 19/00 | 141/381 |
| 1,625,183 | A * | 4/1927 | Abbott | B65D 81/3886 | 215/13.1 |

(Continued)

*Primary Examiner* — Gideon R Weinerth
(74) *Attorney, Agent, or Firm* — Hanley, Flight & Zimmerman, LLC

(57) ABSTRACT

Glass decanters and protective shells for glass decanters are described herein. An example apparatus includes a glass decanter and a protective shell including a first shell portion and a second shell portion couplable with the first shell portion. When the first and second shell portions are coupled, the first and second shell portions form a cavity in which the decanter is to be disposed and which completely encases the decanter.

20 Claims, 12 Drawing Sheets

(56) References Cited

U.S. PATENT DOCUMENTS 1,718,897 A * 6/1929 Samuelr ..... G01F 19/00 222/158
1,855,039 A * 4/1932 Wetmore ..... A47J 41/0083 215/12.1
1,890,323 A * 12/1932 Glaeser ..... B65D 23/0885 215/12.1
1,945,126 A * 1/1934 Gifford ..... A61J 1/16 215/12.1
2,326,414 A * 8/1943 Thompson ..... B65D 7/00 220/4.27
2,568,371 A * 9/1951 Seaver ..... B65D 23/0885 215/12.1
2,889,065 A * 6/1959 Lawlor ..... A45D 34/02 215/12.1
3,076,575 A * 2/1963 Laurance ..... A47J 41/02 215/12.1
3,120,319 A * 2/1964 Buddrus ..... B65D 81/3886 215/12.2
3,229,840 A * 1/1966 Andre ..... B65D 23/00 215/2
3,705,661 A * 12/1972 Davis ..... A47J 41/02 215/6
3,779,298 A * 12/1973 Piccirilli ..... B44C 1/18 220/4.21
3,942,667 A * 3/1976 Thomas ..... B65D 81/022 215/12.1
4,811,858 A * 3/1989 Augur ..... B65D 81/3886 215/13.1
5,148,682 A * 9/1992 Wolf ..... F25D 3/08 220/625
5,904,267 A * 5/1999 Thompson ..... B65D 81/3879 215/12.1
8,225,956 B1 * 7/2012 LeBlanc ..... A47J 43/27 220/568
D695,070 S * 12/2013 Strobel ..... B65D 23/0885 D7/510
8,684,208 B2 * 4/2014 Hotell ..... B65D 21/0209 220/4.26
9,004,281 B1 * 4/2015 Castaneda ..... B01L 9/06 206/446
9,505,527 B1 * 11/2016 Campbell ..... H05K 999/99
9,975,668 B1 * 5/2018 Rimmer ..... A01M 31/008
D830,784 S * 10/2018 Moore ..... B65D 81/3886 D7/608
D831,434 S * 10/2018 Washburn ..... B65D 7/00 D7/608
D923,428 S * 6/2021 Haas ..... A61J 9/08 D7/624.2
11,033,133 B2 * 6/2021 O'Hare ..... A47G 19/2288
2011/0108511 A1 * 5/2011 McKinney ..... B65D 39/0017 215/355
2017/0166385 A1 * 6/2017 Pisarevsky ..... A47G 23/0241
2017/0225831 A1 * 8/2017 Lee ..... B65D 81/02
2020/0359815 A1 * 11/2020 McDaniel ..... A47G 19/12

* cited by examiner

GLASS DECANTER AND PROTECTIVE SHELL

RELATED APPLICATION

This patent claims the benefit under 35 U.S.C. § 119(e) to U.S. Provisional Application No. 62/848,241, titled "Glass Decanter and Protective Shell," filed May 15, 2019, which is hereby incorporated by this reference in its entirety.

FIELD OF THE DISCLOSURE

This disclosure relates generally to glass containers for carrying drinkable liquids and, more particularly, to a glass decanter and a protective shell for the glass decanter.

BACKGROUND

Glass decanters are commonly used to hold liquids, such as alcoholic liquids or spirits. Glass is superior for keeping liquids fresh compared to plastic or metal containers. However, glass is more fragile than other materials such as plastic or metal.

BRIEF DESCRIPTION OF THE DRAWINGS

In FIG. 1, the first and second example shell portions are shown in an unassembled state.

FIG. 9 shows the example protective shell in an assembled state.

Figure 1:
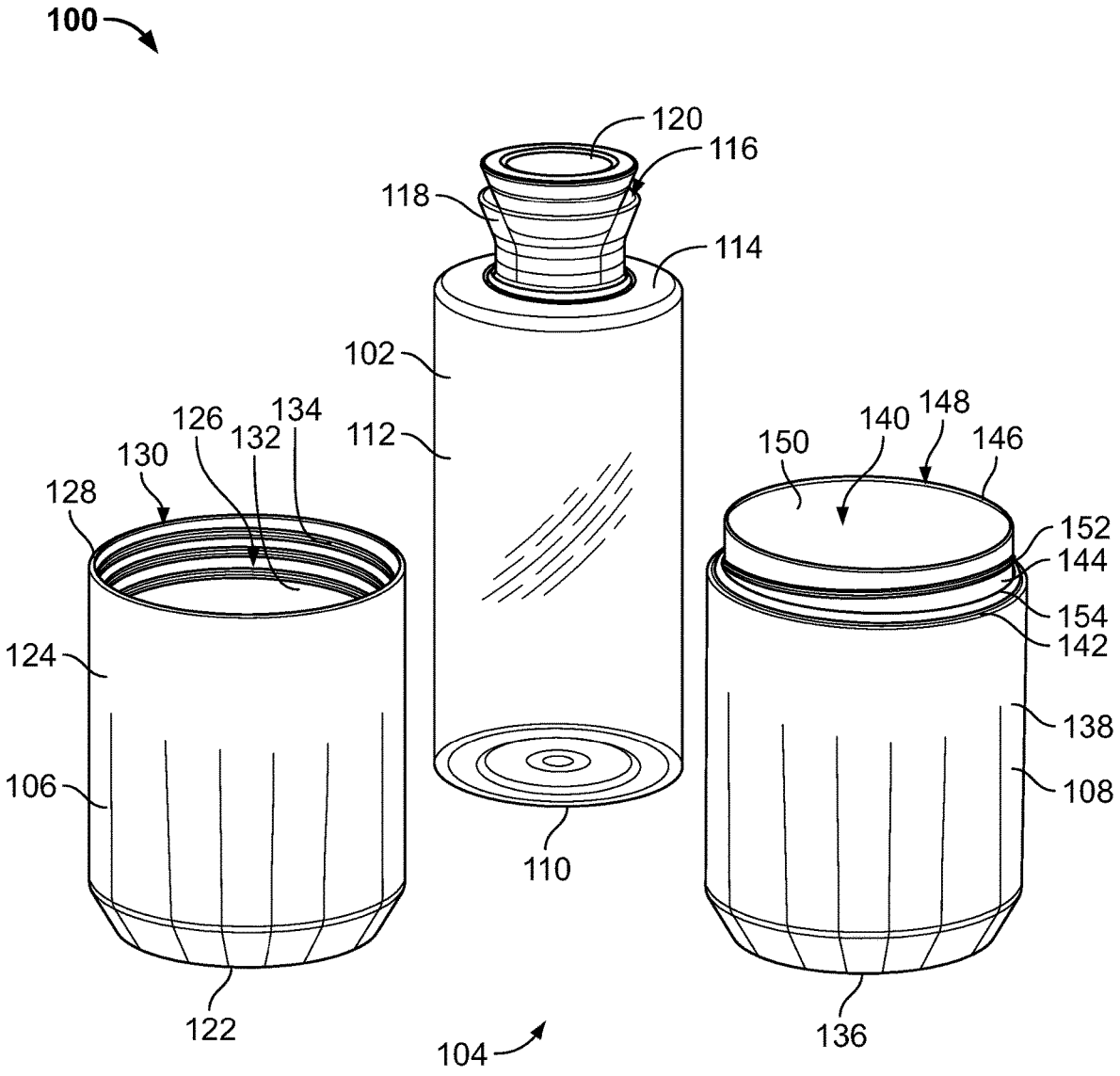
FIG. 1 is a perspective view an example glass decanter and an example protective shell including a first example shell portion and a second example shell portion.

The figures are not to scale. Instead, the thickness of the layers or regions may be enlarged in the drawings. In general, the same reference numbers will be used throughout the drawing(s) and accompanying written description to refer to the same or like parts. As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween. Stating that any part is in contact with another part means that there is no intermediate part between the two parts.

Descriptors "first," "second," "third," etc. are used herein when identifying multiple elements or components that may be referred to separately. Unless otherwise specified or understood based on their context of use, such descriptors are not intended to impute any meaning of priority, physical order or arrangement in a list, or ordering in time but are merely used as labels for referring to multiple elements or components separately for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for ease of referencing multiple elements or components.

DETAILED DESCRIPTION

It is generally known that glass is better for storing drinkable liquids compared to plastic, metal, or other materials, especially alcoholic liquids or spirits. Plastics allow a certain amount of oxygen permeation into a liquid over time, which reduces the quality of the liquid and affects the taste. Metals tend to leach certain toxins (e.g., iron, chromium, nickel) into the liquid over time, which similarly reduces the quality of the liquid and affects the taste. For instance, leaving alcohol in a metal flask often causes the alcohol to taste metallic. Glass, on the other hand, is non-permeable and does not affect color, odor, or taste of the liquid it contains. Specifically, glass is durable and does not leach chemicals into the liquid. Therefore, glass is typically the preferred material for carrying/holding a liquid, especially alcoholic liquids and spirits (e.g., wine, whiskey, scotch, vodka, etc.). However, most people do not prefer to travel with glass containers because glass is more fragile and breakable than metal or plastic. Therefore, most people opt to travel with or transport alcoholic beverages and spirits in a plastic or metal container, even though these containers tend to reduce the quality of the liquid and may negatively affect the taste.

Disclosed herein are an example glass decanter for holding a liquid (e.g., an alcoholic liquid) and a protective shell for protecting the glass decanter. The example protective shell forms a covering or casing around the glass decanter that adds a layer of protection if the decanter is dropped, for example. The protective shell may be constructed of stainless steel, which is more durable than glass. The example decanter and protective shell disclosed herein provide the benefits of storing liquid in a glass container (which keeps the liquid fresher) with the benefits of a stronger, more durable protective container.

An example protective shell disclosed herein includes a first shell portion and a second shell portion couplable with the first shell portion to form the protective shell. The first and second shell portions are cup-shaped. In some examples, the first and second shell portions are constructed of double-walled stainless steel. When the first and second shell portions are coupled, the first and second shell portions form a cavity in which the decanter can be disposed. In some examples, the first and second shell portions include threads to enable the first and second shell portions to be screwed together. In an example operation, a person may fill the decanter with a desired amount of liquid and insert a stopper into an opening of the decanter. The decanter can then be placed between the first and second shell portions and the first and second shell portions are screwed together. Once the first and second shell portions are screwed together, the glass decanter is completely encased or enclosed by the protective shell and, thus, is safer for handling and transport.

In addition to protecting the glass decanter, the first and second shell portions may also be used as drinking cups (e.g., tumblers). For example, the first and second shell portions may be unscrewed, and each of the first and second shell portions can be used as a cup. The liquid in the decanter (and/or another liquid (e.g., a mixer)) can be poured into the first and/or second shell portions and enjoyed.

In some examples, the first and second shell portions and the decanter are sized such that when the first and second shell portions are coupled and the decanter is disposed in the cavity formed by the first and second shell portions, a bottom wall of the decanter is engaged with an inner end surface of the first shell portion and the stopper is engaged with an inner end surface of the second shell portion. Additionally or alternatively, in some examples, a side wall of the decanter is engaged with at least one of an inner side surface of the first shell portion or an inner side surface of the second shell portion. As such, the decanter is held snuggly within the protective shell, which prevents or limits movement of the decanter in the protective shell.

Another example protective shell disclosed herein includes a first shell portion, a second shell portion, and a coupler. The coupler is coupled between the first and second shell portions. In particular, the coupler couples the first and second shell portions. When the first and second shell portions and the coupler are coupled, the first and second shell portions and the coupler form a cavity in which the decanter is to be disposed and which completely encases the decanter. In some examples, the first and second shell portions are threadably coupled (e.g., screwed) to the coupler. For example, the first shell portion includes first internal threads at or near a first opening in the first shell portion, and the second shell portion includes second internal threads at or near a second opening in second shell portion. The coupler includes a central portion, a first wall extending from one end of the central portion, and a second wall extending from an opposite end of the central portion. The first wall has first external threads, and the second wall has second external threads. The first internal and external threads screw together (e.g., mate) to couple the first shell portion and the coupler. Similarly, the second internal and external threads screw together (e.g., mate) to couple the second shell portion and the coupler. As a result, the outer surfaces of the first and second shell portions do not have external protruding threads, which can be a nuisance when drinking from the first and second shell portions.

In some examples, one or more features can be co-molded with the coupler to help stabilize the decanter in the protective shell. For example, a flange can be co-molded with the coupler. The flange extends radially inward from an inner surface of the coupler. When the protective shell is assembled with the decanter disposed in the cavity of the protective shell, the flange engages an outer surface of the decanter to reduce or limit side-to-side movement of the decanter in the protective shell.

These and other example aspects are disclosed in further detail herein. While many of the examples disclosed herein are described in connection with transporting alcoholic beverages or spirits, it is understood that the examples disclosed herein can be used to transport any type of drinkable liquid (e.g., water, milk, juice, etc.) or non-drinkable liquid (e.g., gasoline, cleaning solution, etc.).

Now turning to the figures, FIG. 1 illustrates an example apparatus 100 including an example decanter 102 and an example protective shell 104 for the decanter 102. The decanter 102 is a vessel or container for holding a liquid. In this example, the decanter 102 is constructed entirely of glass (e.g., a single piece of glass). The decanter 102 may be used to carry any type of liquid, such as an alcoholic liquid or spirit. As explained above, glass is an excellent material for holding a liquid, temporarily or for an extended period of time.

In the illustrated example, the protective shell 104 includes a first shell portion 106 and a second shell portion 108 (which may also be referred to as first and second shells). In FIG. 1, the first and second shell portions 106, 108 are shown as separated or in an unassembled state. As disclosed in further detail herein, the first and second shell portions 106, 108 may be coupled (e.g., screwed together) to form the protective shell 104 for protecting the decanter 102. In the unassembled state, as shown in FIG. 1, the first and second shell portions 106, 108 can be used as cups (e.g., tumblers) to drink a liquid, such as the liquid from the decanter 102. In this example, the first and second shell portions 106, 108 are constructed of stainless steel. However, in other examples, the first and second shell portions 106, 108 can be constructed of another material (e.g., aluminum, tin, plastic, etc.).

In the illustrated example, the decanter 102 has a bottom wall 110, a side wall 112, a top wall 114 with an opening 116 for adding liquid to the decanter 102 or removing liquid from the decanter 102. In this example, the decanter 102 has a cylindrical shape. However, it is understood that the decanter 102 can have various other shapes (e.g., a spherical shape, an hour-glass shape, a tear-drop shape, a polygonal shape, etc.). In the illustrated example, the decanter 102 has a throat 118 (which may be referred to as a mouth) extending from the top wall 114. The throat 118 may be useful when pouring a liquid from the decanter 102 to reduce spilling. The opening 116 is defined by the throat 118 through the top wall 114. In other examples, the decanter 102 may not have a throat. In the illustrated example, the apparatus 100 includes a stopper 120 (sometimes referred to as a plug) that may be used to close off and/or seal the opening 116 of the decanter 102. The stopper 120 fits at least partially within the throat 118.

As disclosed above, the decanter 102 is constructed entirely of glass. The glass may be clear or may be colored. In other examples, a portion of the decanter 102 can be constructed of another material (e.g., a glass decanter having a metal bottom or a metal top). In still other examples, the decanter 102 can be constructed entirely of another material. In this example, the decanter 102 has only one opening (i.e., the opening 116) for transferring liquid into and/or out of the decanter 102. However, in other examples, the decanter 102 may include one or more additional openings for adding or removing liquid.

As shown in FIG. 1, the first and second shell portions 106, 108 are cup-shaped. The first shell portion 106 has a first end wall 122 (e.g., a bottom wall or top wall) and a first side wall 124 that defines a first cavity 126. The first side wall 124 has a first edge or lip 128 that defines a first opening 130 (e.g., a mouth) into the first cavity 126. To couple the first and second shell portions 106, 108, the first and second shell portions 106, 108 include threaded sections. For example, a first inner side surface 132 of the first side wall 124 has first threads 134 (internal threads) at or near the first opening 130.

The second shell portion 108 similarly has a second end wall 136 (e.g., a bottom wall or top wall) and a second side wall 138 that defines a second cavity 140. The second side wall 138 has a second edge or lip 142. In this example, the second shell portion 108 has a wall 144 extending from the second lip 142. An edge 146 of the wall 144 defines a second opening 148 (e.g., a mouth) into the second cavity 140. The second shell portion 108 has a second inner side surface 150. In the illustrated example, the second shell portion 108 has second threads 152 (external threads), which are formed on the wall 144. The second threads 152 are at or near the second opening 148. The first and second shell portions 106, 108 may be screwed together via the first and second threads 134, 152 to couple the first and second shell portions 106, 108, as shown in detail in connection with FIGS. 3 and 6. When the first and second shell portions 106, 108 are screwed together, the wall 144 extends into the first opening 130 of the first shell portion 106. In some examples, a seal is to be disposed between the first and second shell portions 106, 108 to help form a sealed cavity when the first and second shell portions 106, 108 are screwed together. For example, as shown in FIG. 1, an O-ring 154 is disposed around the wall 144 of the second shell portion 108.

Figure 2:
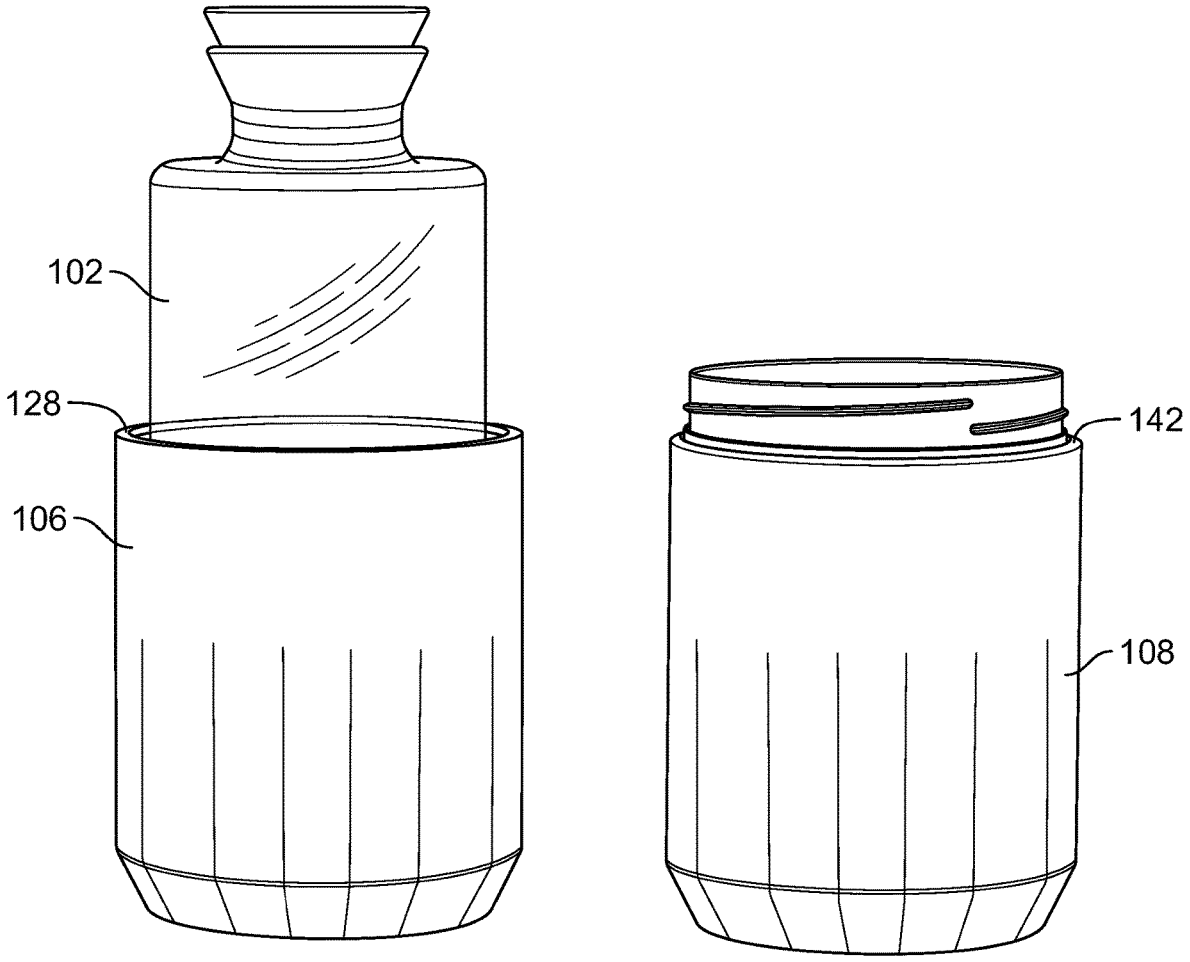
FIG. 2 shows the example decanter of FIG. 1 disposed in one of the example shell portions of the example protective shell.

In an example process, the decanter 102 may be filled with a liquid that is desired to be stored in the decanter 102. Then, the decanter 102 is set in one of the first or second shell portions 106, 108. For example, as shown in FIG. 2, the decanter 102 is set in the first shell portion 106. Then, the second shell portion 108 may be placed over the top half of the decanter 102, and the first and second shell portions 106, 108 may be screwed together. In other examples the decanter 102 can be set in the second shell portion 108 first. In still other examples the decanter 102 can be inserted into the first and second shell portions 106, 108 simultaneously. As the first and second shell portions 106, 108 are screwed together, the first and second lips 128, 142 are moved toward each other.

Figure 3:
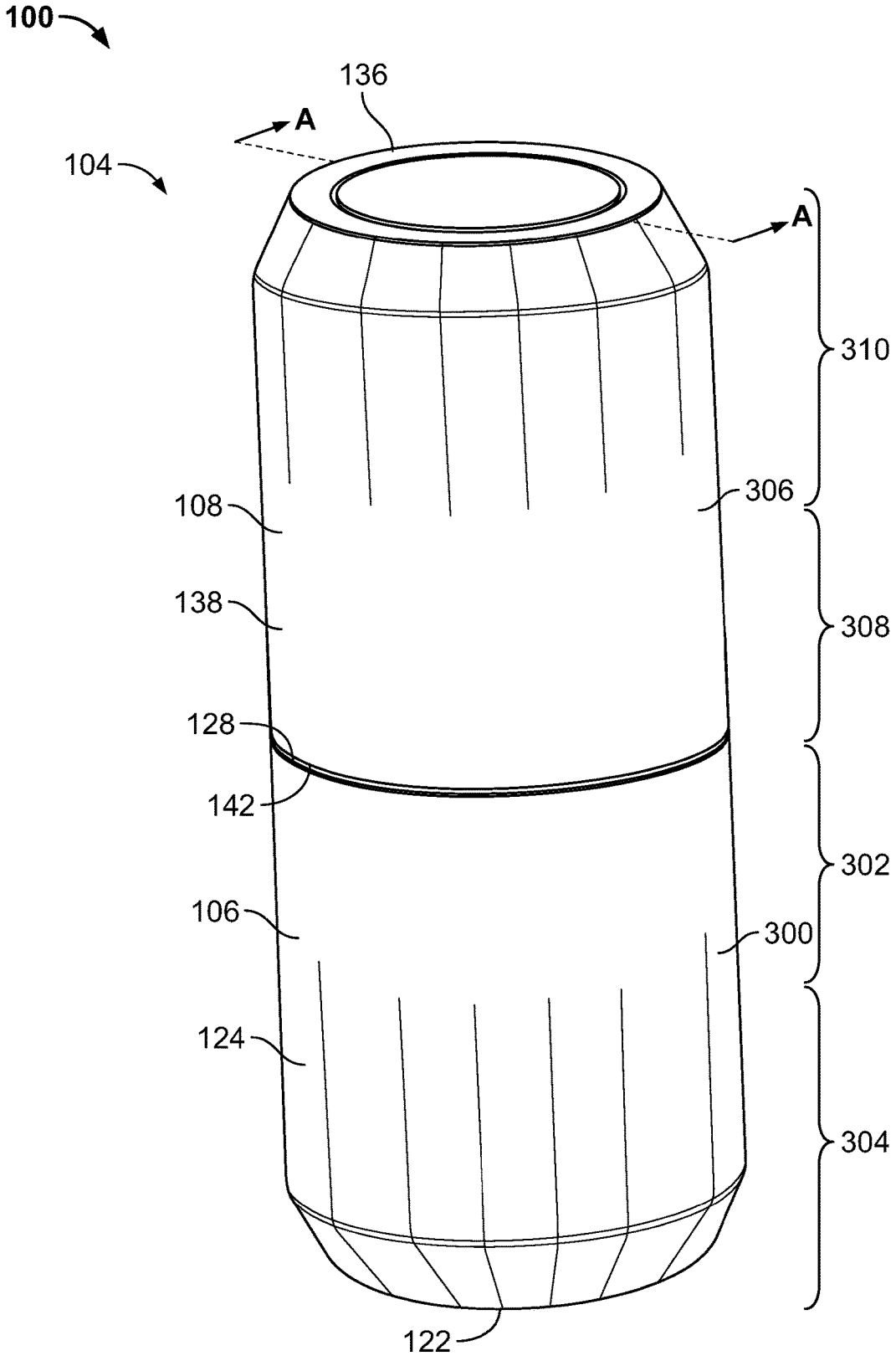
FIG. 3 shows the first and second example shell portions of FIG. 1 in an assembled state with the example decanter disposed in a cavity formed by the first and second example shell portions.

FIG. 3 shows the first and second shell portion 106, 108 screwed together to form the protective shell 104. The protective shell 104 defines a hollow, sealed, leak-proof cavity or vessel. The decanter 102 is disposed within the cavity of the protective shell 104. The protective shell 104 completely surrounds or encases the decanter 102. The protective shell 104 prevents or substantially reduces the likelihood of damage to the decanter 102. The protective shell 104 provides an added layer of protection for the decanter 102 should an object come into contact with the apparatus 100.

When the first and second shell portions 106, 108 are screwed together, the first lip 128 on the first shell portion 106 and the second lip 142 on the second shell portion 108 are moved toward each other. The first and second shell portion 106, 108 can be hand tightened to a sufficient torque. In some examples, the O-ring 154 (FIG. 1) is compressed between the first lip 128 and the second lip 142 to form a substantially leak-proof seal between the first and second shell portions 106, 108. In some examples, the first lip 128 and the second lip 142 do not contact each other. In other examples, the first lip 128 and the second lip 142 may engage or contact each other In the illustrated example, the first and second side walls 124, 138 and the first and second end walls 122, 136 do not have any openings. In other words, besides the first opening 130 (FIG. 1) and the second opening 148 (FIG. 1) (which are sealed when the first and second shell portions 106, 108 are coupled), the first and second shell portions 106, 108 do not have any other openings. As such, when the first and second shell portions 106, 108 are screwed together, the first and second shell portions 106, 108 form a completely enclosed capsule around the decanter 102. As such, if liquid should accidently spill within the protective shell 104, the liquid is contained within the protective shell 104. In other examples, the protective shell 104 may include one or more openings (e.g., an to enable a person to see the decanter 102 within the protective shell 104).

In addition to being used to form the protective shell 104, the first and/or second shell portions 106, 108 can be used as cups (e.g., tumblers) for drinking a liquid, such as the liquid from the decanter 102. For example, the protective shell 104 may be used to protect the decanter 102 during travel or transport. Then, when a person desires to drink liquid from the decanter 102 (and/or another liquid), the first and second shell portions 106, 108 may be unscrewed and the decanter 102 can be removed. Liquid from the decanter 102 and/or another liquid (e.g., water, soda, juice, etc.) can be poured into the first and/or second shell portions 106, 108 and the first and second shell portions 106, 108 can be used as cups to drink the liquid. This is advantageous because it eliminates the need for additional cups to enjoy the liquid from the decanter 102.

As shown in FIG. 3, when the first and second shell portions 106, 108 are screwed together, the interface or joint between the first and second lips 128, 142 is located at or near a center or middle of the protective shell 104 (e.g., ±0.5 inches). In other words, a first distance between the first end wall 122 and the first lip 128 of the first shell portion 106 is substantially the same (e.g., ±0.5 inches) as a second distance between the second end wall 136 and the second lip 142 of the second shell portion 108. As such, in this example, the first and second shell portions 106, 108 form cups that are substantially the same size or volume (although, because of the wall 144 (FIG. 1), the second shell portion 108 may have a slightly larger volume than the first shell portion 106). In other examples, the first side wall 124 of the first shell portion 106 and/or the second side wall 138 of the second shell portion 108 may be longer or shorter, resulting in different sized shell portions (i.e., different volumes). For example, the first shell portion 106 may make up 75% of the protective shell 104, and the second shell portion 108 may make up 25% of the protective shell 104.

In some examples, at least a portion of an outer surface of the protective shell 104 includes a feature to enhancing gripping. For example, an outer surface 300 of the first shell portion 106 has a first section 302 and a second section 304. In this example, each of the first and second sections 302, 304 each make up about half of the outer surface 300 of the first shell portion 106. The first section 302 has a smooth, circular profile. However, the second section 304 of the first shell portion 106 has a faceted profile (e.g., a polygonal cross-section). The transition between the profiles of the first and second sections 302, 304 is gradual. An outer surface 306 of the second shell portion 108 similarly has first section 308 that is smooth and circular and a second section 310 that has a faceted profile (e.g., a polygonal cross-section). The faceted (polygonal) profile of the second sections 304, 310 forms a plurality of flat side surfaces. These flat surfaces and the ridges between the flat surfaces provide better grip when screwing and unscrewing the first and second shell portions 106, 108. In other examples, the entire outer surfaces 300, 306 of the first and second shell portion 106, 108 may have the faceted profiles. In other examples, the entire outer surfaces 300, 306 may be substantially smooth and/or have a differently shaped profile.

In the illustrated example of FIG. 3, the first side wall 124 of the first shell portion 106 is tapered (e.g., angled or beveled) near the first end wall 122. Similarly, the second side wall 138 of the second shell portion 108 is tapered near the second end wall 136. These tapered sections help reduce sharp corners or edges. However, in these examples, these sections may be shaped differently (e.g., a sharp corner, a rounded edge, etc.).

Figure 4:
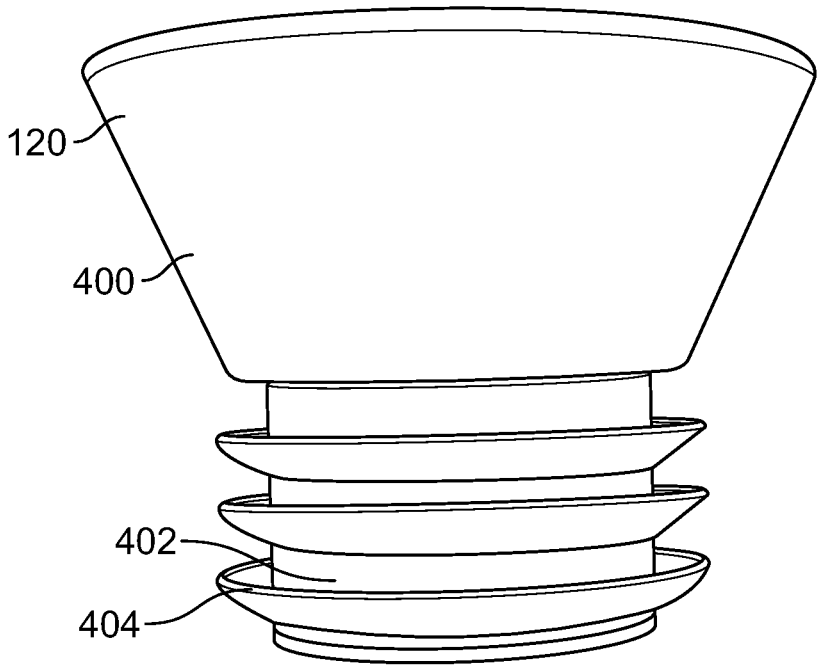
FIG. 4 is a side view of an example stopper that can be used with the example decanter of FIG. 1.

FIG. 4 shows a side view of the stopper 120. In the illustrated example, the stopper 120 has a first portion 400 and a second portion 402. The first and second portions 400, 402 may be made of the same material or a different material (e.g., rubber and rubber, rubber and plastic, etc.). The first portion 400 is tapered to match a taper of the throat 118 (FIG. 1), as shown in further detail in connection with FIG. 5. The second portion 402 is cylindrical. In the illustrated example, three fins 404 (one of which is labeled in FIG. 4) extend outward (and, in some examples, upward) from the second portion 402. The fins 404 are to engage the decanter 102 to form a seal, as shown in connection with FIG. 5. The stopper 120 may include more fins (e.g., four, five, etc.) or fewer fins (e.g., two, one). In this example, the stopper 120 is a non-screw (non-threaded) stopper. As such, the stopper 120 may be pushed linearly into the opening 116 to seal the opening 116.

Figure 5:
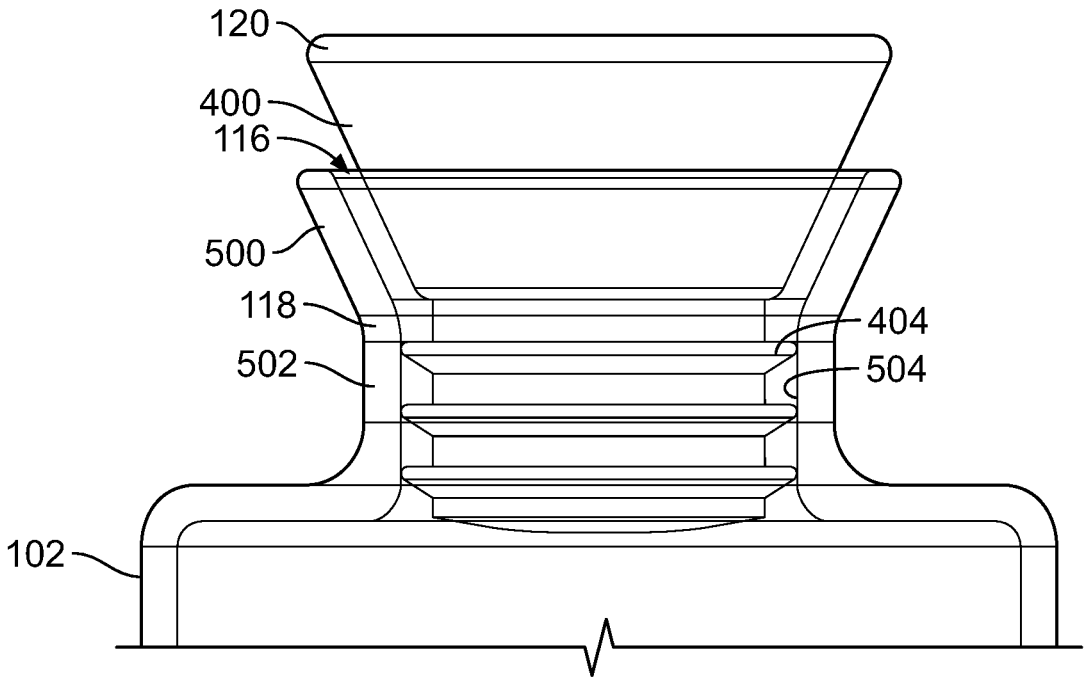
FIG. 5 is a side view the example stopper of FIG. 4 in a throat of the example decanter of FIG. 1.

FIG. 5 shows the stopper 120 inserted into the throat 118 of the decanter 102. The throat 118 has a first portion 500 that is tapered (e.g., wedge-shaped) and a second portion 502 that is not tapered. The stopper 120 may be inserted into the opening 116 of the decanter 102 to seal the opening 116. When the stopper 120 is inserted in the opening 116, the first portion 400 of the stopper 120 is disposed in the first portion 500 of the throat 118 and the second portion 402 of the stopper 120 is disposed in the second portion 502 of the throat 118. The fins 404 (one of which is labeled in FIG. 5) engage an inner surface 504 of the throat 118, which creates a substantially liquid tight seal to prevent the liquid from spilling out of the throat 118 of the decanter 102 and reduce or eliminate evaporation of the liquid in the decanter 102. The tapered profiles of the first portion 400 of the stopper 120 and the first portion 500 of the throat 118 prevent the stopper 120 from being inserted too far into the opening 116. While in this example a non-screw type stopper is implemented, in other examples, other types of caps (e.g., a screw cap) may be used on the decanter 102.

Figure 6:
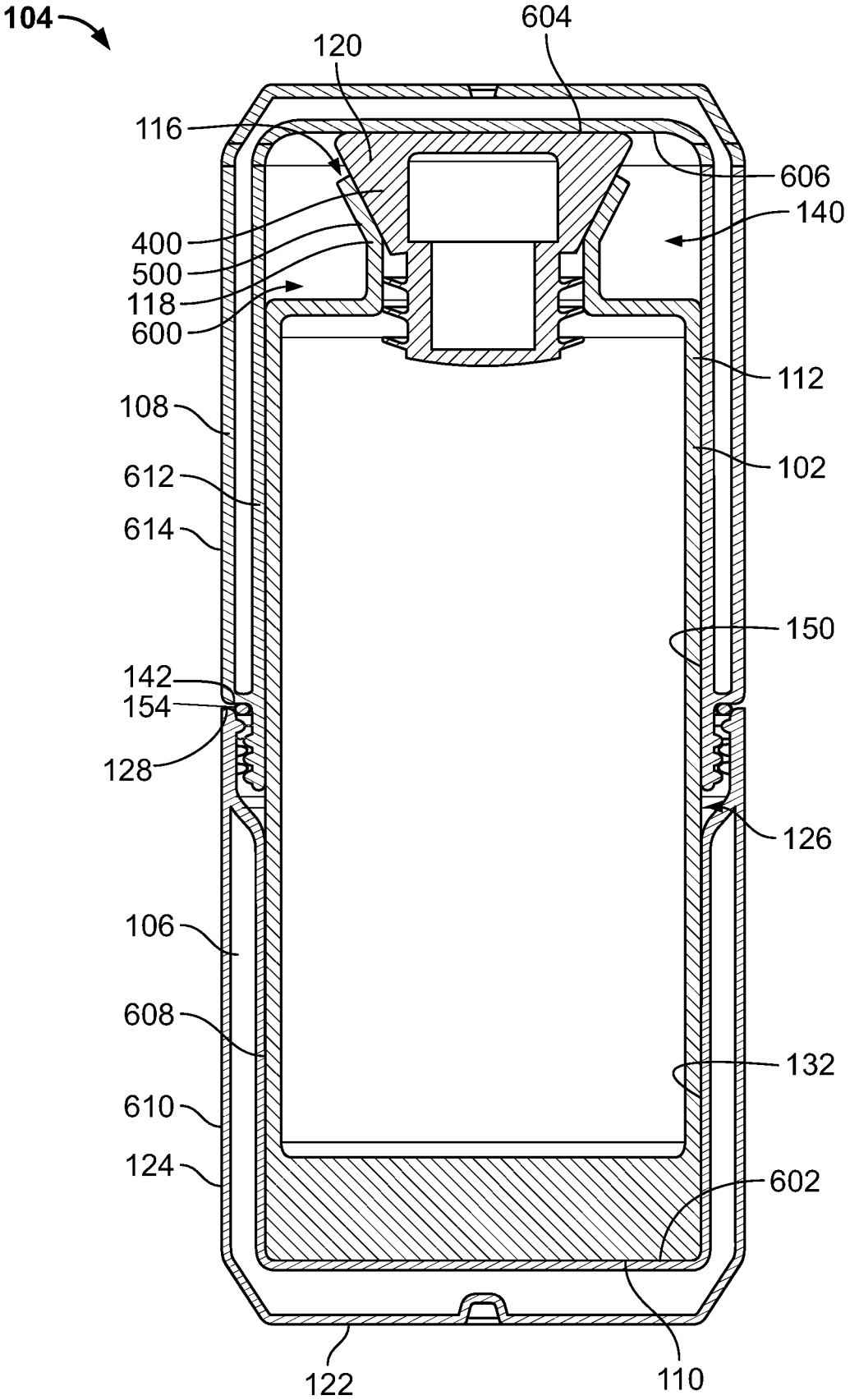
FIG. 6 is a cross-sectional view of the example protective shell and the example decanter taken along line A-A of FIG. 3.

FIG. 6 is a cross-sectional view of the protective shell 104 and the decanter 102 taken along line A-A of FIG. 3. The first and second shell portions 106, 108 are screwed together. The first and second shell portions 106, 108, when screwed together, form a cavity 600, which is a combination of the first and second cavities 126, 140 of the respective first and second shell portions 106, 108. The O-ring 154 is compressed between the first lip 128 and the second lip 142, which helps maintain a sealed, leak-proof cavity.

When the decanter 102 is disposed in the protective shell 104, one or more contact points may be formed between the protective shell 104 and the decanter 102 to prevent or limit movement (e.g., rattling, shaking) of the decanter 102 relative to the protective shell 104. In some examples, the first and second shell portions 106, 108 and the decanter 102 are sized such that when the first and second shell portions 106, 108 are screwed together (and the decanter 102 is disposed in the cavity 600), the bottom wall 110 of the decanter 102 is engaged with a first inner end surface 602 of the first shell portion 106 and a top 604 of the stopper 120 is engaged with a second inner end surface 606 of the second shell portion 108. As such, the decanter 102 is limited or prevented from moving up-and-down in the cavity 600 relative to the protective shell 104. In some examples, as the first and second shell portions 106, 108 are screwed together, the second inner end surface 606 pushes the stopper 120 a predetermined depth into the opening 116 in the throat 118. In some examples, such as the example shown in FIG. 6, the stopper 120 is pushed into the opening 116 until the first portion 400 of the stopper 120 contacts the first portion 500 of the throat 118. In other examples, the first portion 400 of the stopper 120 may remain spaced apart from the first portion 500 of the throat 118. In some examples, the bottom wall 110 may not contact the first inner end surface 602 of the first shell portion 106. Instead, a bottom corner/edge of the decanter 102 may contact or become wedged in a bottom corner of the first shell portion 106. In such an example, the bottom wall 110 is not in contact with the first inner end surface 602 of the first shell portion 106, but the decanter 102 is still prevented from moving further toward the first inner end surface 602. In some examples, to help further limit or prevent movement, one or more pads (e.g., a felt pad, a rubber pad, etc.) may be coupled to the top 604 of the stopper 120 and/or the bottom wall 110 of the decanter 102. In other examples, the first and second shell portions 106, 108 and the decanter 102 may be sized such that when the first and second shell portions 106, 108 are screwed together, there is a gap between the bottom wall 110 of the decanter and the first inner end surface 602 and/or between the top 604 of the stopper and the second inner end surface 606, such that a small amount of up-and-down movement may occur.

In some examples, the first and second shell portions 106, 108 and the decanter 102 are sized such that when the decanter 102 is disposed in the cavity 600, the side wall 112 of the decanter 102 is in contact with first inner side surface 132 of the first shell portion 106 and/or the second inner side surface 150 of the second shell portion 108, which prevents or limits side-to-side movement of the decanter 102 in the protective shell 104. Therefore, the decanter 102 may be held snuggly in the protective shell 104. The first and second shell portions 106, 108 may have inner diameters that are substantially the same as the outer diameter of the decanter 102. In other examples, the first and second shell portions 106, 108 and the decanter 102 may be sized such that there is a gap or space between the side wall 112 of the decanter 102 and the first and or second inner side surfaces 132, 150 (i.e., the inner diameters of the first and second shell portions 106, 108 are larger than the outer diameter of the decanter 102). In some examples, a ridge and/or ring may be used to fill the gap, examples of which are disclosed in further detail in connection with FIGS. 7 and 8.

In some examples, the first and/or second shell portions 106, 108 may be double-walled (e.g., constructed of double-walled stainless steel). For example, as shown in FIG. 6, the first shell portion 106 includes an inner wall 608 and an outer wall 610. The gap between the inner and outer walls 608, 610 may be filled with gas, such as air. The outer wall 610 forms the first side wall 124 and the first end wall 122, and the inner wall 608 forms the first inner side surface 132 and the first inner end surface 602. The inner and outer walls 608, 610 of the first shell portion 106 are coupled at the first lip 128. Similarly, the second shell portion 108 is also double-walled. The second shell portion 108 has an inner wall 612 and an outer wall 614 separated by a space filled with a gas. The inner and outer walls 612, 614 are coupled at the second lip 142. The double-walled design insulates the cavity 600, thereby reducing temperature changes in the cavity 600 caused by temperatures outside of the protective shell 104. This helps keep the liquid in the decanter 102 warm or cold (depending on the temperature of the liquid initially added to the decanter 102). In other examples, the first and second shell portions 106, 108 may not have a double-walled design. Instead, the side walls and end walls may be single walls.

Figure 7:
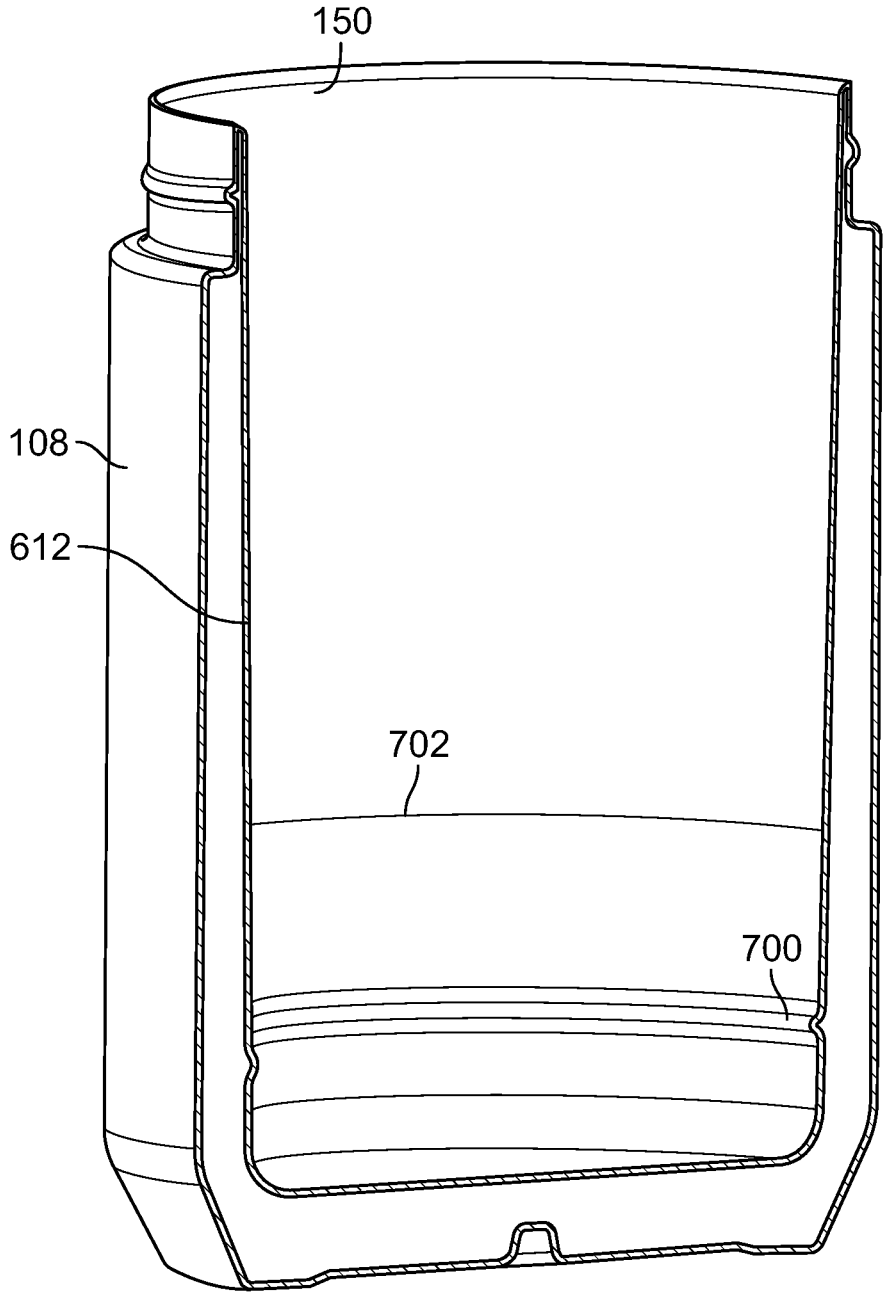
FIG. 7 is a cross-sectional view of one of the example shell portions of FIG. 1 showing an example ridge that may be implemented with the example shell portion.

As disclosed above, in some examples, the first and second shell portions 106, 108 and the decanter 102 may be sized such that there is a gap or space between the side wall 112 of the decanter 102 and the first and or second inner side surfaces 132, 150 of the first and second shell portions 106, 108. In some such examples, the first and/or second shell portions 106, 108 may include one or more ridges or protrusions that extend inward to contact the decanter 102 and prevent or limit movement of the decanter 102 in the protective shell 104. For example, FIG. 7 shows an alternative design of the second shell portion 108. As shown in FIG. 7, the inner wall 612 of the second shell portion 108 has a ring-shaped ridge 700 that extends radially inward. The diameter of the opening formed by the ring-shaped ridge 700 may be substantially the same size (e.g., ±0.1 inches) as the outer diameter of the decanter 102 (FIG. 6). As such, when the decanter 102 is disposed in the second shell portion 108, the outer surface of the decanter 102 engages the ring-shaped ridge 700. In some examples, multiple ring-shaped ridges may be implemented on the second shell portion 108. The first shell portion 106 may similarly include one or more ring-shaped ridges.

In some examples, the first and/or second shell portions 106, 108 include one or more indicators inside of the respective shell portions 106, 108 to indicate a particular volume. For example, the ring-shaped ridge 700 formed in the second shell portion 108 may be positioned to define a particular volume in the second shell portion 108, such as 2 fluid ounces (fl. oz). Therefore, the ring-shaped ridge 700 may be used as a volume indicator when a person is using the second shell portion 108 as a cup. The second shell portion 108 may include additional rings or ridges to indicate additional volumes (e.g., 4 fl. Oz, 6 fl. Oz, etc.). The first shell portion 106 may similarly include one or more rings or ridges to indicate one or more volumes. In other examples, one or more of the rings or ridges may be indented radially outward instead of inward.

Additionally or alternatively, the first and second shell portions 106, 108 can include etchings or markings (e.g., a painted line) to indicate particular volumes in the respective first and second shell portions 106, 108. For example, as shown in FIG. 7, the second shell portion 108 includes a marking 702 that that indicates a particular volume, such as 4 fl. Oz.

Figure 8:
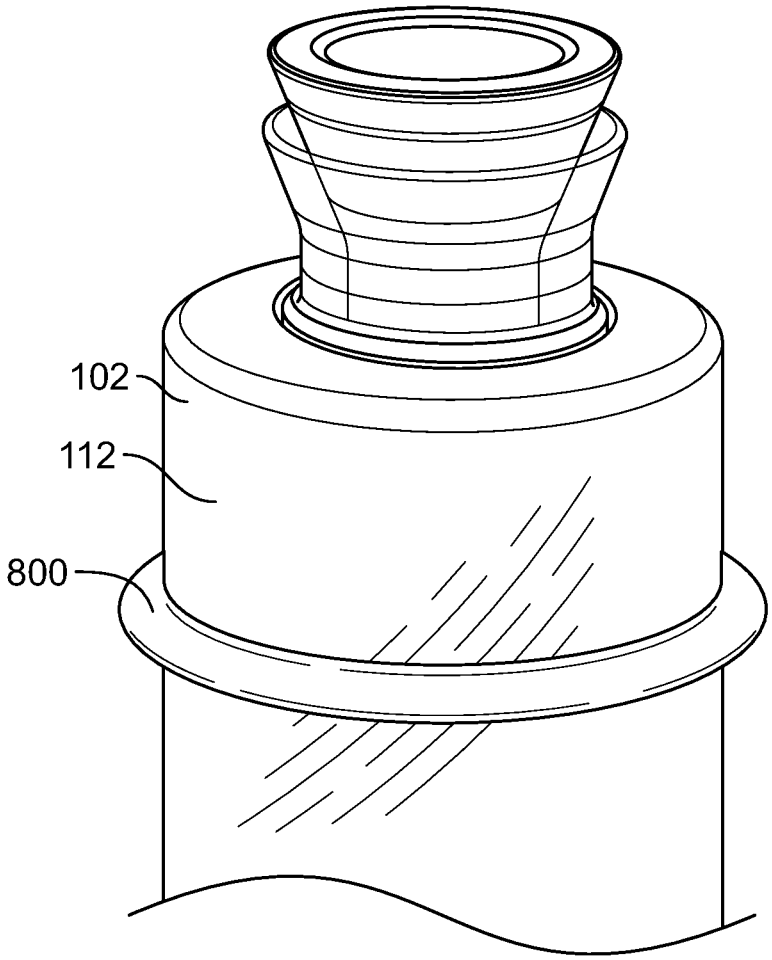
FIG. 8 shows an example flexible ring that can be placed around the example decanter of FIG. 1.

In some examples, the apparatus 100 includes a flexible ring disposed around the decanter 102 to help reduce movement of the decanter 102 while the decanter 102 is disposed in the protective shell 104. For example, FIG. 8 shows an example flexible ring 800 disposed around the side wall 112 of the decanter 102. In some examples, the flexible ring 800 is constructed of silicone and/or rubber. The flexible ring 800 may be hold on the decanter 102 via a friction fit. When the decanter 102 is disposed in the protective shell 104 (FIG. 6), the flexible ring 800 may engage the inner surface of one of the first or second shell portions 106, 108, which helps prevent side-to-side and/or up-down movement of the decanter 102 in the protective shell 104. In some examples, the flexible ring 800 is removable, and may be slid onto and/or off of the decanter 102 as desired. In other examples, the flexible ring 800 may be fixedly attached to the decanter 102. In some examples, multiple rings are used.

In the illustrated examples disclosed above, the first and second shell portions 106, 108 are coupled via threaded engagement (i.e., screwed together). In other examples, in addition to or as an alternative to the threads, the first and second shell portions 106, 108 can be coupled in other manners. For example the first and/or second shell portions 106, 108 may include one or more magnets that magnetically couple the first and second shell portions 106, 108. As another example, the wall 144 of the second shell portion 108 may not have threads and instead may be designed to form an interference fit (e.g., friction fit) with the first inner side surface 132 of the first shell portion 106.

Figure 9:
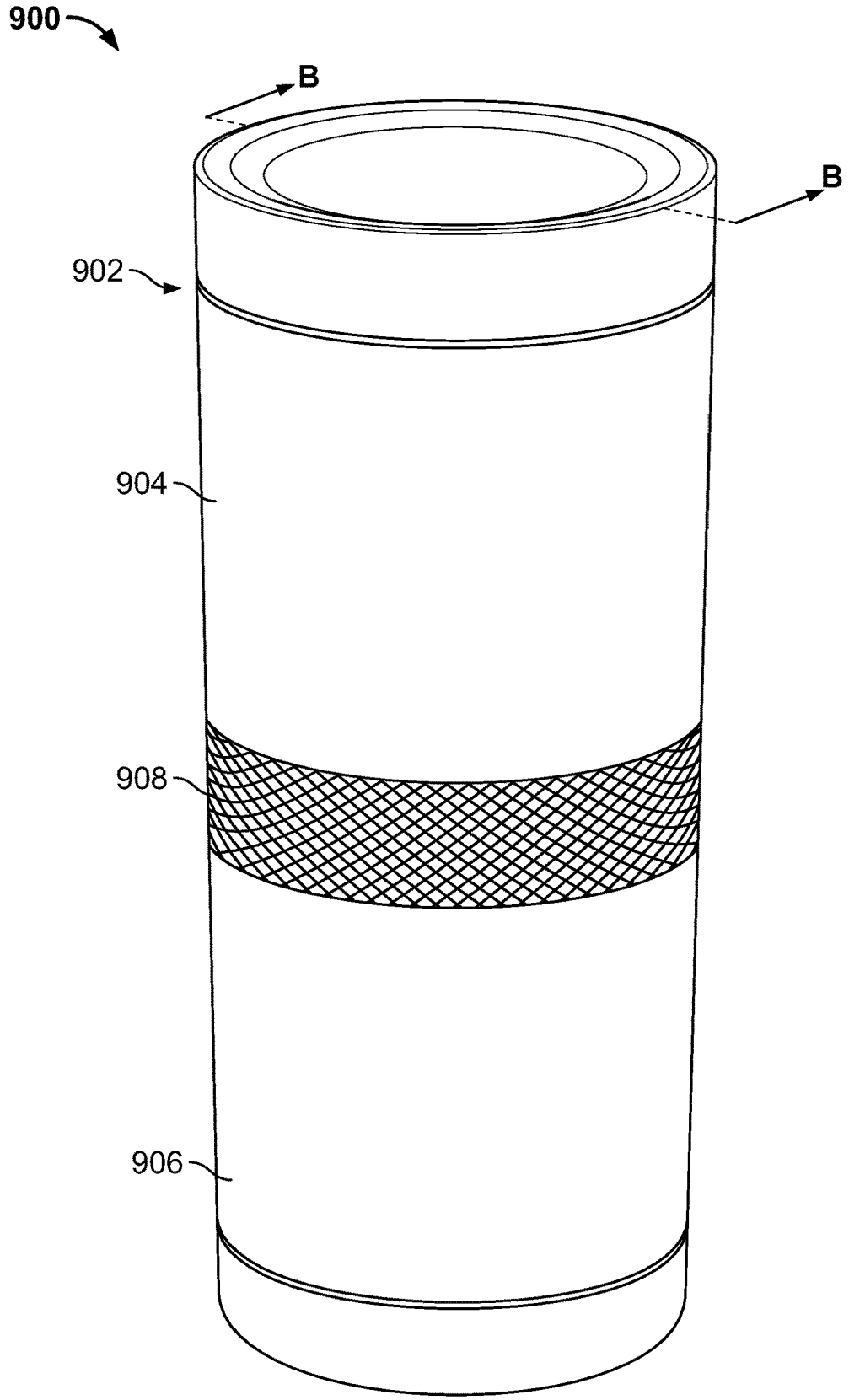
FIG. 9 is a perspective view of an example protective shell including an example first shell portion, an example second shell portion, and an example coupler.

FIG. 9 illustrates another example apparatus 900 including an example protective shell 902 for holding a decanter, such as the decanter 102 (FIG. 1). In the illustrated example, the protective shell 902 is shown in an assembled stated. The example protective shell 900 is described in connection with the decanter 102. However, it is understood that the example protective shell 900 can be used in connection with other types of decanters or containers.

In the illustrated example, the protective shell 902 includes a first shell portion 904 (which may also be referred to as a first shell), a second shell portion 906 (which may also be referred to as a second shell), and a coupler 908. The coupler 908 is coupled between the first and second shell portions 904, 906. In particular, the first shell portion 904 is coupled to one end of the coupler 908, and the second shell portion 906 is coupled to the other end of the coupler 908. Thus, the coupler 908 couples the first and second shell portions 904, 906. In some examples, the first shell portion 904, the second shell portion 906, and the coupler 908 are threadably coupled (e.g., screwed together), as disclosed in further detail herein. The first and second shell portions 904, 906 and the coupler 908 can be hand tightened to a sufficient torque.

In the assembled state, the protective shell 902 defines a hollow, sealed, leak-proof cavity or vessel. The decanter 102 can be disposed within the cavity of the protective shell 902, such that the protective shell 902 completely surrounds or encases the decanter 102. The protective shell 902 prevents or substantially reduces the likelihood of damage to the decanter 102. The protective shell 902 provides an added layer of protection for the decanter 102 should an object come into contact with the apparatus 900.

Figure 10:
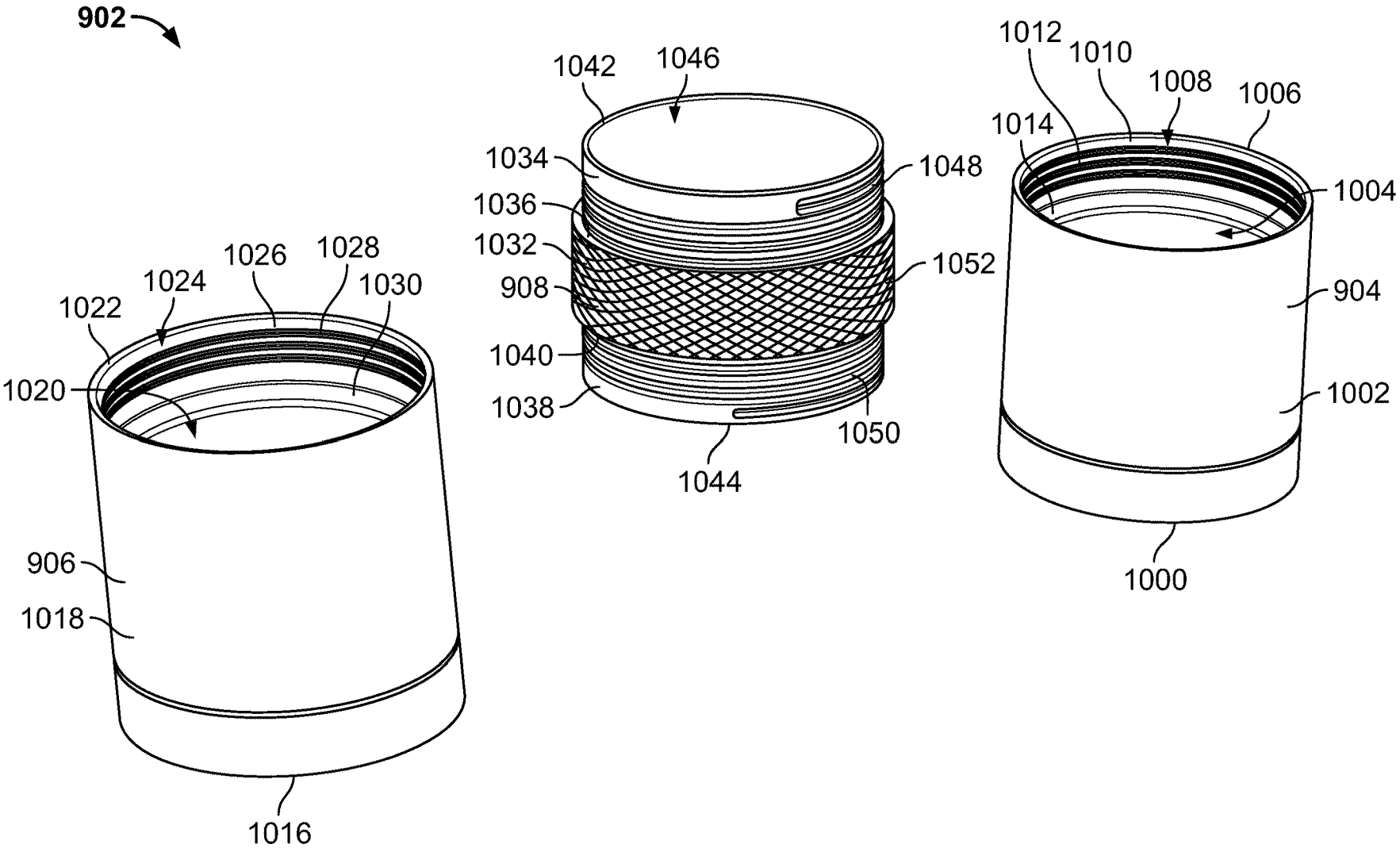
FIG. 10 shows the example protective shell of FIG. 9 in an unassembled state.

FIG. 10 shows the protective shell 902 is an unassembled state. In particular, the first and second shell portions 904, 906 have been disconnected (e.g., unscrewed) from the coupler 908. The first and second shell portions 904, 906 are cup-shaped. The first and second shell portions 904, 906 can be used as cups (e.g., tumblers) to drink a liquid, such as the liquid from the decanter 102.

In the illustrated example, the first shell portion 904 has a first end wall 1000 (e.g., a bottom wall or top wall) and a first side wall 1002 that defines a first cavity 1004. The first side wall 1002 has a first edge or lip 1006 that defines a first opening 1008 (e.g., a mouth) into the first cavity 1004. The first shell portion 904 has first internal threads 1012 (e.g., female threads) on a first inner side surface 1010 of the first shell portion 904 at or near the first opening 1008. A first ledge 1014 (e.g., a shoulder) is formed in the first inner side surface 1010 below the first internal threads 1012.

In the illustrated example, the second shell portion 906 has a second end wall 1016 (e.g., a bottom wall or top wall) and a second side wall 1018 that defines a second cavity 1020. The second side wall 1018 has a second edge or lip 1022 that defines a second opening 1024 (e.g., a mouth) into the second cavity 1020. The second shell portion 906 has second internal threads 1028 on a second inner side surface 1026 of the second shell portion 906 at or near the second opening 1024. A second ledge 1030 (e.g., a shoulder) is formed in the second inner side surface 1026 below the second internal threads 1028.

In the illustrated example, the coupler 908 has a central portion 1032, a first wall 1034 extending from a first end 1036 of the central portion 1032, and a second wall 1038 extending from a second end 1040 of the central portion 1032 opposite the first wall 1034. The first wall 1034 has a first edge or lip 1042 and the second wall 1038 has a second edge or lip 1044. A channel or passage 1046 is formed through the coupler 908. The first wall 1034 has first external threads 1048 (e.g., male threads) on an outer surface of first wall 1034. The second wall 1038 has second external threads 1050 on an outer surface of the second wall 1038.

To couple the first and second shell portions 904, 906 and the coupler 908, the first and second shell portions 904, 906 and the coupler 908 can be screwed together. For example, the first wall 1034 of the coupler 908 is inserted into the first opening 1008 of the first shell portion 904 and the first internal threads 1012 of the first shell portion 904 and the first external threads 1048 of the coupler 908 are screwed together. In some examples, when the first shell portion 904 and the coupler 908 are fully screwed together, the first lip 1006 of the first shell portion 904 engages the first end 1036 of the central portion 1032 of the coupler 908, and the first lip 1042 of the coupler 908 engages the first ledge 1014 in the first shell portion 904. Similarly, the second wall 1038 of the coupler 908 is inserted into the second opening 1024 of the second shell portion 906 and the second internal threads 1028 of the second shell portion 906 and the second external threads 1050 of the coupler 908 are screwed together. In some examples, when second shell portion 906 and the coupler 908 are screwed together, the second lip 1022 of the second shell portion 906 engages the second end 1040 of the central portion 1032 of the coupler 908, and the second lip 1044 of the coupler 908 engages the second ledge 1030 in the second shell portion 906. In some examples, one or more seals can be disposed between the first and second shell portions 904, 906 and the coupler 908 to help form a sealed cavity when the first and second shell portions 904, 906 and the coupler 908 are screwed together. For example, seals (e.g., o-rings) can be provided on the first and second ledges 1014, 1030 and the first and second ends 1036, 1040.

In this example, the first and second internal threads 1012, 1028 on the first and second shell portions 904, 906 are internal threads and, thus, are not exposed on the outer surfaces of the first and second shell portions 904, 906. This is advantageous when using the first and/or second shell portions 904, 906 for drinking, because the user's lips do not engage external threads on the outside of the first and/or second shell portions 904, 906.

In some examples, the first and second shell portions 904, 906 are constructed of metal, such as stainless steel. In some examples, similar to the first and second shell portions 104, 106 disclosed above in FIG. 6, the first and second shell portions 904, 906 can be double-walled stainless steel. In other examples, the first and second shell portions 904, 906 can be constructed of other materials, such as plastic. In this example, the first and second shell portions 904, 906 are identical. This reduces manufacturing costs as only one mold or forming procedure is needed. The first and second shell portions 904, 906 can include etchings or markings (e.g., a painted line) to indicate particular volumes in the respective first and second shell portions 904, 906.

In some examples, the coupler 908 is constructed (e.g., molded) a single unitary part or component. In some examples, the coupler 908 is constructed of plastic. In other examples, the coupler 908 can be constructed of other materials, such as metal.

In some examples, at least a portion of an outer surface of the protective shell 902 includes a feature to enhancing gripping. For example, as shown in FIG. 10, the outer surface of the central portion 1032 includes knurling 1052. These knurling 1052 enhances gripping when screwing and/or unscrewing the first and second shell portions 904, 906 and the coupler 908. Additionally or alternatively, the outer surfaces of the first and/or second shell portions 904, 906 can include faceted profiles, as disclosed in connection with FIG. 3.

Figure 11:
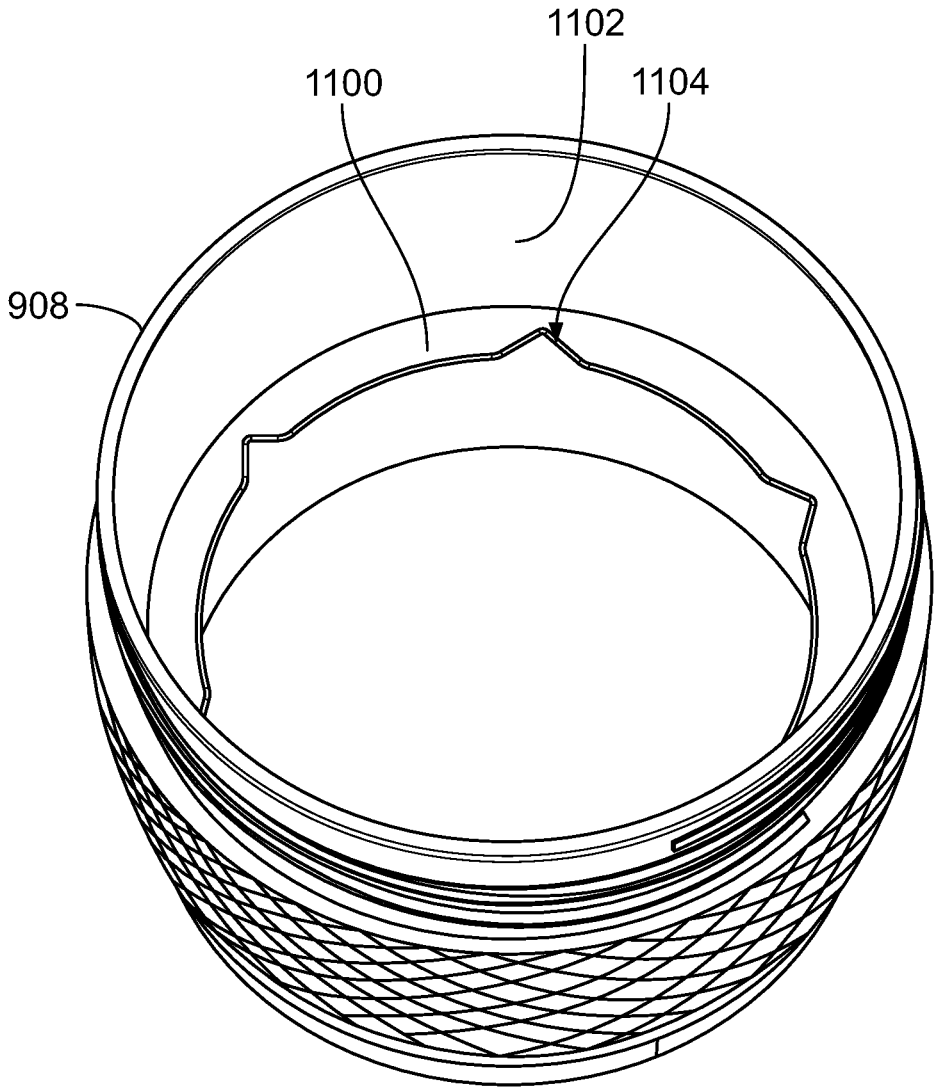
FIG. 11 shows an example flange in the example coupler of FIG. 9.

In some examples, the protective shell 902 can include one or more features to increase contact points between the protective shell 902 and the decanter 102 to reduce or limit movement of the decanter 102 in the protective shell 902. For example, as shown in FIG. 11, the protective shell 902 includes a flange 1100 (e.g., a ring). In this example, the flange 1100 is coupled to and extends radially inward from an inner surface 1102 of the coupler 908. In some examples, the flange 1100 is constructed of a flexible material, such as silicone. When the protective shell 902 is assembled with the decanter 102 disposed in the protective shell 902, the flange 110 engages the side wall 112 of the decanter 102, which reduces or limits side-to-side movement of the decanter 102. In some examples, as shown in FIG. 11, the flange 1100 has notches 1104 (one of which is referenced in FIG. 11) to enhance the flexibility of the flange 1100. In some examples, the flange 1100 is co-molded with the coupler 908. As such, the coupler 908 enables the inclusion of a stabilizing feature, which is easier to construct with the coupler 908 than incorporating with the first or second shell portions 904, 906. In other examples, the flange 1100 is coupled to the inner surface 1102 of the coupler 908 with an adhesive or other chemical or mechanical fastening technique.

Figure 12:
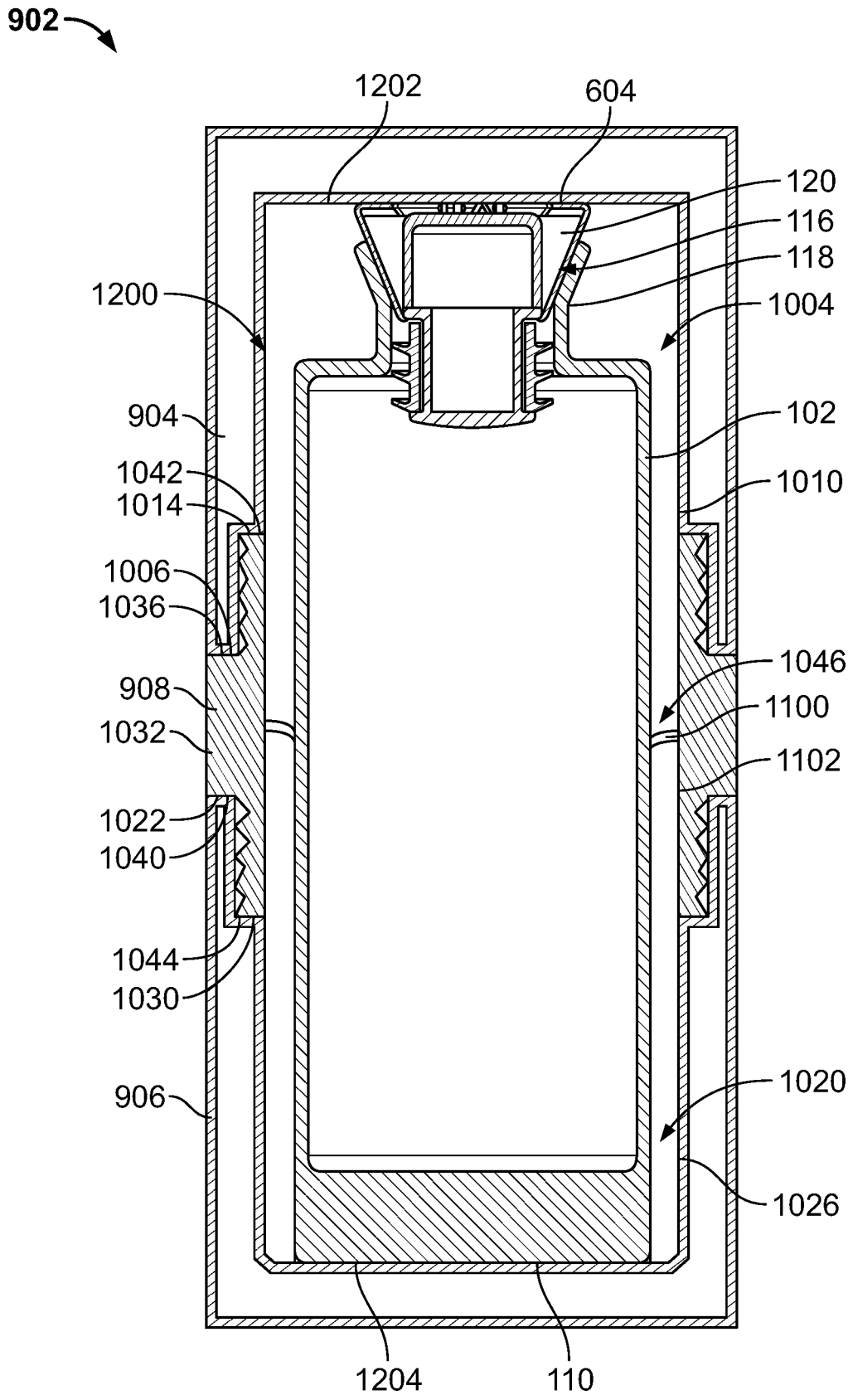
FIG. 12 is a cross-sectional view of the example protective shell and the example decanter taken along line B-B of FIG. 9.

FIG. 12 is a cross-sectional view of the protective shell 902 and the decanter 102 taken along line B-B of FIG. 9. The first and second shell portions 904, 906 and the coupler 908 are screwed together. The first and second shell portions 904, 906 and the coupler 908, when screwed together, form a cavity 1200, which is a combination of the first and second cavities 1004, 1020 of the respective first and second shell portions 904, 906 and the space defined by the passageway 1046 of the coupler 908. The first inner side surface 1010 of the first shell portion 904, the second inner side surface 1026 of the second shell portion 906, and the inner surface 1102 of the coupler 908 the have substantially the same diameter, which forms a substantially uniform inner surface of the protective shell 902.

As shown in FIG. 12, when the first shell portion 904 and the coupler 908 are screwed together, the first lip 1006 of the first shell portion 904 engages the first end 1036 of the central portion 1032 of the coupler 908, and the first lip 1042 of the coupler 908 engages the first ledge 1014 in the first shell portion 904. In other examples, only the first lip 1006 and the first end 1036 engage, only the first lip 1042 and the first ledge 1014 engage, or none of the surfaces make contact. Similarly, when the second shell portion 906 and the coupler 908 are screwed together, the second lip 1022 of the second shell portion 906 engages the second end 1040 of the central portion 1032 of the coupler 908, and the second lip 1044 of the coupler 908 engages the second ledge 1030 in the second shell portion 906. In other examples, only the second lip 1022 and the second end 1040 engage, only the second lip 1044 and the second ledge 1030 engage, or none of the surfaces make contact.

When the decanter 102 is disposed in the protective shell 902 and the protective shell 902 is assembled, one or more contact points may be formed between the protective shell 902 and the decanter 102 to prevent or limit movement (e.g., rattling, shaking) of the decanter 102 relative to the protective shell 902. In some examples, the first and second shell portions 904, 906, the coupler 908, and the decanter 102 are sized such that when the first and second shell portions 904, 906 and the coupler 908 are screwed together (and the decanter 102 is disposed in the cavity 1200), the top 604 of the stopper 120 is engaged with a first inner end surface 1202 of the first shell portion 904, and the bottom wall 110 of the decanter 102 is engaged with a second inner end surface 1204 of the second shell portion 906. As such, the decanter 102 is limited or prevented from moving up-and-down in the cavity 1200 relative to the protective shell 902. In some examples, as the first and second shell portions 904, 906 and the coupler 908 are screwed together, the first inner end surface 1202 pushes the stopper 120 a predetermined depth into the opening 116 in the throat 118. In some examples, such as the example shown in FIG. 12, the stopper 120 is pushed into the opening 116 until the first portion 400 (FIG. 4) of the stopper 120 contacts the first portion 500 (FIG. 5) of the throat 118. In other examples, the first portion 400 of the stopper 120 may remain spaced apart from the first portion 500 of the throat 118. In some examples, the bottom wall 110 may not contact the second inner end surface 1204 of the second shell portion 906. Instead, a bottom corner/edge of the decanter 102 may contact or become wedged in a bottom corner of the second shell portion 906. In such an example, the bottom wall 110 is not in contact with the second inner end surface 1204 of the second shell portion 906, but the decanter 102 is still prevented from moving further toward the second inner end surface 1204. In some examples, to help further limit or prevent movement, one or more pads (e.g., a felt pad, a rubber pad, etc.) may be coupled to the first inner end surface 1202 and/or the second inner end surface 1204. In other examples, the first and second shell portions 904, 906, the coupler 908 and the decanter 102 may be sized such that when the first and second shell portions 904, 906 and the coupler 908 are screwed together, there is a gap between the bottom wall 110 of the decanter 102 and the second inner end surface 1204 and/or between the top 604 of the stopper 120 and the first inner end surface 1202, such that a small amount of up-and-down movement may occur.

As shown in FIG. 12, the flange 1100 is engaged with the outer surface of the decanter 102. In some examples, the flange 1100 is elastically deformed (e.g., curved or bent) when inserting the decanter 102. The flange 1100 limits side-to-side movement of the decanter 102 in the cavity 1200. In other examples, more than one flange can be disposed on the inner surface of the protective shell 902. Additionally or alternatively, one or more flexible rings, such as the flexible ring 800, can be disposed around the decanter 102, and/or one or more ridges, such as the ring-shaped ridge 700, can be formed on the inner surface(s) of the first and/or second shell portions 904, 906. In other examples, the first and second shell portions 904, 906, the coupler 908, and the decanter 102 can be sized such that when the decanter 102 is disposed in the cavity 1200, the side wall 112 of the decanter 102 is in contact with first inner side surface 1010 of the first shell portion 106, the second inner side surface 1026 of the second shell portion 908, and/or the inner surface 1102 of the coupler 908, to prevent or limit side-to-side movement of the decanter 102 in the protective shell 902.

Figure 13A:
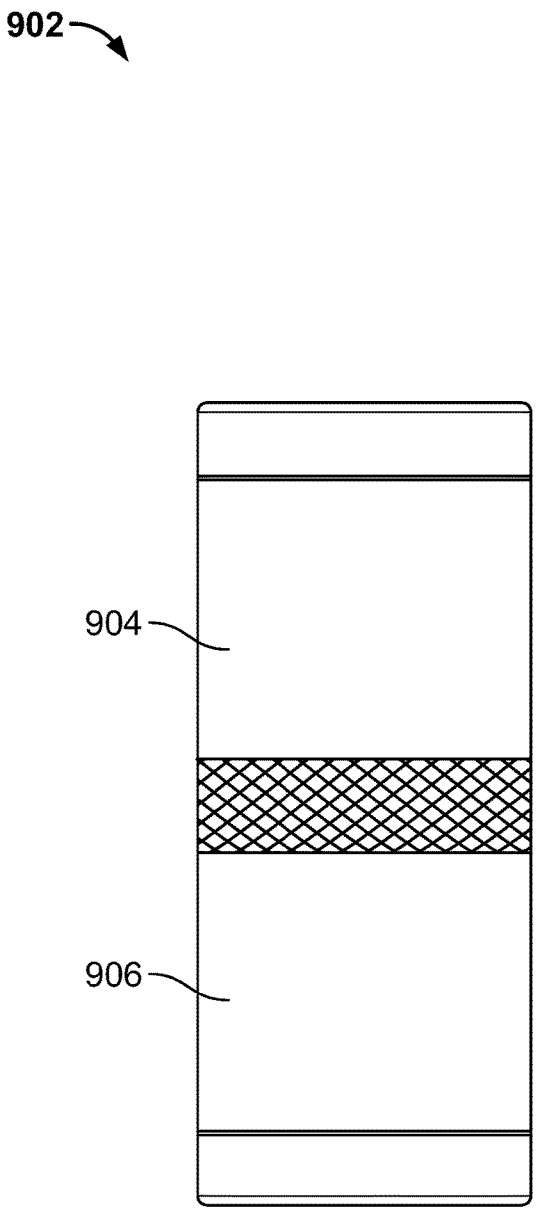
FIG. 13A is a side view of the example protective shell of FIG. 9.
Figure 13B:
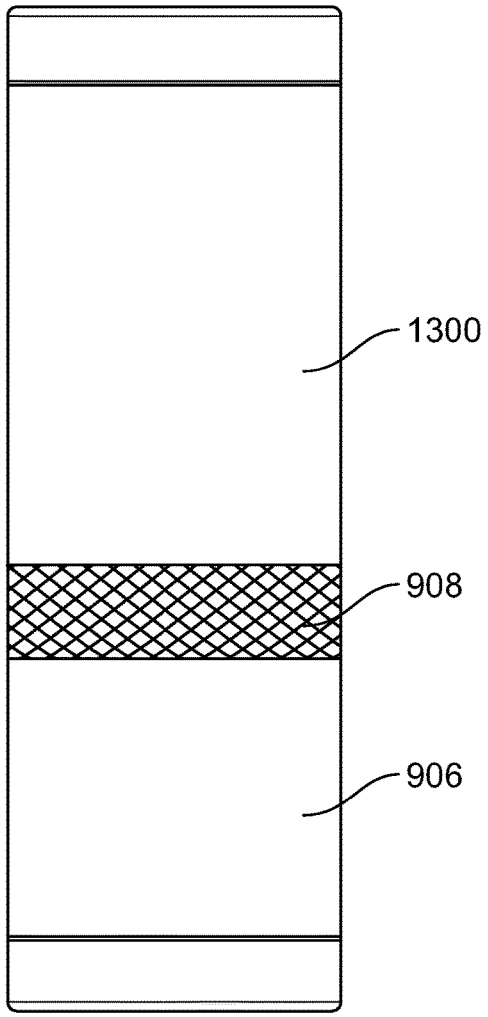
FIG. 13B is a side view of an example protective shell with a larger shell portion.

FIG. 13A is a side view of the protective shell 902. In this example, the first and second shell portions 904, 906 are the same height (in the vertical direction in FIG. 13A). One or both of the shell portions 904, 906 can be increased or decreased in size. For example, FIG. 13B shows a larger first shell portion 1300 used with the coupler 908 and the second shell portion 906. This increases the size of the cavity 1200 (FIG. 12) for accommodating a larger decanter, for example. This also increases the drinking capacity of the first shell portion 1300 when used as a cup. In addition to or as an alternative to changing the size of the first and/or second shell portions 904, 906, the coupler 908 can also be constructed smaller or larger to change the overall height of the protective shell 902. In some examples, multiple shell portions and couplers having different sizes can be sold as a kit, and a user can mix-and-match the shell portions and the couplers to form a protective shell having a desired size.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, and (3) at least one A and at least one B.

From the foregoing, it will be appreciated that examples have been disclosed that enable safe transportation of a glass decanter. The examples provide the advantages of a glass decanter (which keeps liquids relatively fresh compared to other materials) and the advantages of a metal shell for protecting the glass decanter.

The following paragraphs provide various examples of the examples disclosed herein.

Example 1 is an apparatus including a glass decanter and a protective shell including a first shell portion and a second shell portion couplable with the first shell portion. When the first and second shell portions are coupled, the first and second shell portions form a cavity in which the decanter is to be disposed and which completely encases the decanter.

Example 2 includes the apparatus of Example 1, wherein the first shell portion includes first threads at or near a first opening in the first shell portion and the second shell portion includes second threads at or near a second opening in the second shell portion. The first and second shell portions are to be screwed together to form the protective shell.

Example 3 includes the apparatus of Example 2, wherein the first shell portion has a first lip and the second shell portion has a second lip.

Example 4 includes the apparatus of Example 3, wherein the second shell portion includes a wall extending from the second lip. The second threads are formed on the wall.

Example 5 includes the apparatus of Example 4, wherein, when the first and second shell portions are screwed together, the wall of the second shell portion extends into the first opening of the first shell portion.

Example 6 includes the apparatus of Example 5, further including an O-ring disposed around the wall of the second shell portion.

Example 7 includes the apparatus of Example 6, wherein, when the first and second shell portions are screwed together, the O-ring is compressed between the first and second lips.

Example 8 includes the apparatus of any of Examples 3-7, wherein a first distance between a first end wall of the first shell portion and the first lip of the first shell portion is substantially the same as a second distance between a second end wall of the second shell portion and the second lip of the second shell portion.

Example 9 includes the apparatus of any of Examples 1-8, further including a stopper to be disposed in an opening of the decanter.

Example 10 includes the apparatus of Example 9, wherein the first and second shell portions and the decanter are sized such that when the first and second shell portions are coupled and the decanter is disposed in the cavity formed by the first and second shell portions, a bottom wall of the decanter is engaged with a first inner end surface of the first shell portion and the stopper is engaged with a second inner end surface of the second shell portion.

Example 11 includes the apparatus of Example 10, wherein the first and second shell portions and the decanter are sized such that when the first and second shell portions are coupled and the decanter is disposed in the cavity formed by the first and second shell portions, a side wall of the decanter is engaged with at least one of a first inner side surface of the first shell portion or a second inner side surface of the second shell portion.

Example 12 includes the apparatus of any of Examples 1-11, wherein the first shell portion has an inner wall with a ring-shaped ridge extending inward. The ring-shaped ridge is to engage a side wall of the decanter when the decanter is disposed in the first shell portion.

Example 13 includes the apparatus of any of Examples 1-12, further including a flexible ring disposed around the decanter. The flexible ring is to engage an inner side surface of the first shell portion or the second shell portion when the decanter is disposed in the cavity.

Example 14 includes the apparatus of Example 13, wherein the flexible ring is constructed of silicone.

Example 15 includes the apparatus of any of Examples 1-14, wherein the first shell portion includes a marking on an inner side surface of the first shell portion to indicate a particular volume in the first shell portion.

Example 16 includes the apparatus of any of Examples 1-15, wherein at least a section of the first shell portion has a polygonal cross-section forming flat side surfaces on an outer surface of the first shell portion.

Example 17 includes the apparatus of Example 16, wherein at least a section of the second shell portion has a polygonal cross-section forming flat side surface on an outer surface of the first shell portion.

Example 18 includes the apparatus of any of Examples 1-16, wherein the first and second shell portions are constructed of double-walled stainless steel.

Example 19 is an apparatus including a glass decanter, and a protective shell including a first shell portion, a second shell portion, and a coupler to be coupled between the first and second shell portions. When the first and second shell portions and the coupler are coupled, the first and second shell portions and the coupler form a cavity in which the decanter is to be disposed and which completely encases the decanter.

Example 20 includes the apparatus of Example 19, wherein the first shell portion includes first internal threads at or near a first opening in the first shell portion and the second shell portion includes second internal threads at or near a second opening in the second shell portion.

Example 21 includes the apparatus of Example 20, wherein the coupler includes a first wall with first external threads and a second wall with second external threads. The first external threads are to mate with the first internal threads to couple the first shell portion and the coupler. The second external threads are to mate with the second internal threads to couple the second shell portion and the coupler.

Example 22 includes the apparatus of any of Examples 19-21, wherein an outer surface of a portion of the coupler includes knurling.

Example 23 includes the apparatus of any of Examples 19-22, further including a flange coupled to and extending radially inward from an inner surface of the coupler.

Example 24 includes the apparatus of Example 23, wherein the flange is constructed of silicone.

Although certain example methods, apparatus, and articles of manufacture have been disclosed herein, the scope of coverage of this patent is not limited thereto. On the contrary, this patent covers all methods, apparatus, and articles of manufacture fairly falling within the scope of the claims of this patent.

What is claimed is:

1. An apparatus comprising:

a glass decanter; and a protective shell including:

a first shell portion, the first shell portion including a first inner wall and a first outer wall separated by a first air gap, a first portion of the first inner wall being curved radially inward relative to portions of the first inner wall above and below the first portion, the first portion forming a first ring-shaped ridge; and a second shell portion couplable with the first shell portion, the second shell portion including a second inner wall and a second outer wall separated by a second air gap, a second portion of the second inner wall being curved radially inward relative to portions of the second inner wall above and below the second portion, the second portion forming a second ring-shaped ridge, when the first and second shell portions are coupled, the first and second shell portions form a cavity in which the decanter is to be disposed and which completely encases the decanter, and when the first and second shell portions are coupled and the decanter is disposed in the cavity, the first and second ring-shaped ridges engage an outer surface of the decanter.

2. The apparatus of claim 1, wherein the first shell portion includes first threads at or near a first opening in the first shell portion and the second shell portion includes second threads at or near a second opening in the second shell portion, the first and second shell portions to be screwed together to form the protective shell.

3. The apparatus of claim 2, wherein the first shell portion has a first lip and the second shell portion has a second lip.

4. The apparatus of claim 3, wherein the second shell portion includes a wall extending from the second lip, the second threads formed on the wall.

5. The apparatus of claim 4, wherein, when the first and second shell portions are screwed together, the wall of the second shell portion extends into the first opening of the first shell portion.

6. The apparatus of claim 5, further including an O-ring disposed around the wall of the second shell portion.

7. The apparatus of claim 6, wherein, when the first and second shell portions are screwed together, the O-ring is compressed between the first and second lips.

8. The apparatus of claim 3, wherein a first distance between a first end wall of the first shell portion and the first lip of the first shell portion is substantially the same as a second distance between a second end wall of the second shell portion and the second lip of the second shell portion.

9. The apparatus of claim 1, further including a stopper to be disposed in an opening of the decanter, the first and second shell portions and the decanter are sized such that when the first and second shell portions are coupled and the decanter is disposed in the cavity formed by the first and second shell portions, a bottom wall of the decanter is engaged with a first inner end surface of the first shell portion and the stopper is engaged with a second inner end surface of the second shell portion.

10. The apparatus of claim 9, wherein the first and second shell portions and the decanter are sized such that when the first and second shell portions are coupled and the decanter is disposed in the cavity formed by the first and second shell portions, a side wall of the decanter is engaged with at least one of a first inner side surface of the first shell portion or a second inner side surface of the second shell portion.

11. The apparatus of claim 1, wherein at least a section of the first shell portion has a polygonal cross-section forming flat side surfaces on an outer surface of the first shell portion.

12. The apparatus of claim 11, wherein at least a section of the second shell portion has a polygonal cross-section forming flat side surface on an outer surface of the second shell portion.

13. The apparatus of claim 1, wherein the first inner wall, the first outer wall, the second inner wall, and the second outer wall are constructed of stainless steel.

14. The apparatus of claim 1, wherein the first ring-shaped ridge is positioned at a location relative to a bottom of the first inner wall that corresponds to a two fluid ounce volume in the first shell portion, and wherein the second ring-shaped ridge is positioned at a location relative to a bottom of the second inner wall that corresponds to a two fluid ounce volume in the second shell portion.

15. An apparatus comprising:

a glass decanter; and a protective shell including:

a first shell portion;

a second shell portion;

a coupler to be coupled between the first and second shell portions, the coupler having a first edge, a second edge opposite the first edge, and an inner surface defining a channel extending between the first edge and the second edge, when the first and second shell portions and the coupler are coupled, the first and second shell portions and the coupler form a cavity in which the decanter is to be disposed and which completely encases the decanter; and a flange co-molded with the coupler, the flange extending radially inward from the inner surface of the coupler at a location between the first edge and the second edge, the flange having an inner peripheral edge with a curvature corresponding to a curvature of an outer surface of the decanter such that when the protective shell is assembled and the decanter is disposed in the protective shell, the flange engages the outer surface of the decanter to reduce or limit side-to-side movement of the decanter in the protective shell.

16. The apparatus of claim 15 wherein the first shell portion includes first internal threads at or near a first opening in the first shell portion and the second shell portion includes second internal threads at or near a second opening in the second shell portion, and wherein the coupler includes:

a central portion;

a first wall extending from a first end of the central portion, the first wall having first external threads to mate with the first internal threads to couple the first shell portion and the coupler; and a second wall extending from a second end of the central portion opposite the first wall, the second wall having second external threads to mate with the second internal threads to couple the second shell portion and the coupler.

17. The apparatus of claim 16 wherein an outer surface of a portion of the central portion of the coupler includes knurling.

18. The apparatus of claim 15, wherein the flange is constructed of silicone.

19. An apparatus comprising:

a glass decanter; and a protective shell including:

a first shell portion, the first shell portion having a first outer surface with a first section and a second section, the first section having smooth circular profile, the second section defining a polygonal cross-section formed by a first plurality of flat side surfaces disposed adjacent each other around the second section of the first shell portion, the first outer surface having a gradual transition between the first section and the second section; and a second shell portion couplable with the first shell portion, when the first and second shell portions are coupled, the first and second shell portions form a cavity in which the decanter is to be disposed and which completely encases the decanter, the second shell portion having a second outer surface with a third section and a fourth section, the third section having a smooth circular profile, the fourth section defining a polygonal cross-section formed by a second plurality of flat side surfaces disposed adjacent each other around the fourth section of the second shell portion, the second outer surface having a gradual transition between the third section and the fourth section, the first and second pluralities of flat side surfaces to enhance grip when coupling or decoupling the first and second shell portions.

20. The apparatus of claim 19, wherein:

the first section extends between a first lip of the first shell portion and a first transition between the first and second sections;

the second section extends between the first transition and a first end wall of the first shell portion opposite the first lip;

the third section extends between a second lip of the second shell portion and a second transition between the third and fourth sections; and the fourth section extends between the second transition and a second end wall of the second shell portion opposite the second lip, such that when the first and second shell portions are coupled, the first and third sections are between the second and fourth sections.

* * * * *